US005283105A

United States Patent [19]

Groner et al.

[11] Patent Number: 5,283,105

[45] Date of Patent: Feb. 1, 1994

[54] TRANSPARENT ELECTROSTATOGRAPHIC-TONER-IMAGE-RECEIVING ELEMENT

[75] Inventors: C. Fred Groner, Rochester; William A. Light, Victor, both of N.Y.

[73] Assignee: Eastman Kodak Company, Rochester, N.Y.

[21] Appl. No.: 927,789

[22] Filed: Aug. 10, 1992

Related U.S. Application Data

[63] Continuation of Ser. No. 688,011, Apr. 19, 1991, abandoned.

[51] Int. Cl.[5] ..... B41M 5/035

[52] U.S. Cl. ..... 428/195; 428/323; 428/327; 428/341; 428/913; 428/143; 503/227; 8/471

[58] Field of Search ..... 428/209, 910, 207, 323, 428/195, 327, 341, 913, 143

[56] References Cited

U.S. PATENT DOCUMENTS

| | | | |
|---|---|---|---|
| 4,242,396 | 12/1980 | Wilson et al. | 428/141 |
| 4,415,626 | 11/1983 | Hasenauer et al. | 428/323 |
| 4,480,003 | 10/1984 | Edwards et al. | 428/329 |
| 4,481,252 | 11/1984 | Postle et al. | 428/323 |
| 4,526,847 | 7/1985 | Walker et al. | 430/18 |
| 4,869,955 | 9/1989 | Ashcraft et al. | 428/327 |
| 4,873,135 | 10/1989 | Wittnebel et al. | 428/192 |
| 4,876,235 | 10/1989 | DeBoer | 503/227 |

*Primary Examiner*—Patrick J. Ryan
*Assistant Examiner*—Cathy K. Lee
*Attorney, Agent, or Firm*—Robert Luke Walker

[57] ABSTRACT

A transparent electrostatographic-toner-image-receiving element comprises a substrate sheet having on each side thereof a layer comprising a polymeric binder having dispersed therein, at a concentration of at least about 2 percent by weight, a mixture of particles protruding from the layer, said mixture comprising:

A. first particles comprising either amorphous silica having a volume median particle size of about 2–3 micrometers or poly(methyl methacrylate-co-divinylbenzene) having a volume median particle size of about 4–5 micrometers and B. second particles comprising poly(methyl methacrylate-co-divinylbenzene) having a volume median particle size in a range of from greater than the volume median particle size of the first particles to about 12 micrometers.

9 Claims, No Drawings

TRANSPARENT ELECTROSTATOGRAPHIC-TONER-IMAGE-RECEIVING ELEMENT

This is a continuation of application Ser. No. 07/688,011, filed on Apr. 19, 1991, now abandoned.

FIELD OF THE INVENTION

This invention relates to a transparent sheet element suitable for receiving thereon an electrostatographically produced toner image to be viewed by transmitted light, e.g., by projection in an overhead projector. More particularly, the invention relates to such elements comprising transparent substrate sheets having transparent image-receiving polymeric binder layers on both sides thereof and to improvements to such elements in order to increase the reliability of feeding the elements through electrostatographic imaging machines.

BACKGROUND

In electrostatography an image comprising a pattern of electrostatic potential (also referred to as an electrostatic latent image) is formed on an insulative surface by any of various methods. For example, the electrostatic latent image may be formed electrophotographically (i.e., by imagewise radiation-induced discharge of a uniform potential previously formed on a surface of an electrophotographic element comprising at least a photoconductive layer and an electrically conductive substrate), or it may be formed by dielectric recording (i.e., by direct electrical formation of a pattern of electrostatic potential on a surface of a dielectric material). Typically, the electrostatic latent image is then developed into a toner image by contacting the latent image with an electrographic developer (if desired, the latent image can be transferred to another surface before development). The resultant toner image can then be fixed in place on the surface by application of heat and/or pressure or other known methods (depending upon the nature of the surface and of the toner image) or can be transferred by known means to another surface, to which it then can be similarly fixed.

In many electrostatographic imaging processes, the surface to which the toner image is intended to be ultimately transferred and fixed is the surface of a sheet of plain paper or, when it is desired to view the image by transmitted light (e.g., by projection in an overhead projector), the surface of a transparent film sheet element.

Transparent electrostatographic-toner-image-receiving elements are generally well known in the art of electrostatography. They often comprise a transparent substrate sheet having on one or both sides thereof a transparent image-receiving polymeric binder layer. See, for example, U.S. Pat. Nos. 4,873,135; 4,869,955; 4,526,847; 4,481,252; 4,480,003; and 4,415,626, the disclosures of which are hereby incorporated herein by reference.

One recurring problem with polymeric-binder-coated film sheets involves feeding the sheets through electrophotographic copiers. While most copiers contain apparatus that will fairly reliably feed plain paper through the machine, such apparatus often fails to feed polymeric-binder-coated film sheets through the machine with as high a degree of reliability. Failures often occur in the form of misfeeds, i.e., failure of the feeding apparatus to successfully remove one sheet from a stack of such sheets and properly direct it through the sheet-transport path in the machine, often resulting in a jam in the machine.

The problem is recognized in the art, and attempts have been made to overcome it. Such attempts have often involved adding discrete particles of various materials to the image-receiving polymeric binder layer, such that some of the particles protrude from the outer surface of the layer, in order to lessen the degree of contact between sheets in a stack and thereby allow them to move over each other more easily, and in order to provide a rougher surface to the sheets to increase the amount of friction between the sheets and sheet-feeding apparatus to thereby improve the ability of the apparatus to transport the sheets properly. See, for example, all of the U.S. Patents identified above.

While such added particles do generally reduce the frequency of misfeeds, in many cases the reduction is not enough to reach desired levels of reliability. Also, levels of reliability can vary with the particular type of feeding apparatus in particular types of copiers, so that even though a particular type of receiving element may feed very reliably in one particular type of copier, it may feed much less reliably in another particular type of machine.

Thus, there is a continuing need to provide improved transparent image-receiving elements that will exhibit higher levels of feeding reliability in electrostatographic imaging apparatus and, preferably, that will exhibit such high levels of feeding reliability in various different particular types of imaging apparatus.

SUMMARY OF THE INVENTION

The present invention meets the above-noted need by providing a transparent electrostatographic-toner-image-receiving element comprising a substrate sheet having on each side thereof a layer comprising a polymeric binder having dispersed therein, at a concentration of at least about 2 percent by weight, a mixture of particles protruding from the layer, said mixture comprising:

A. first particles comprising either amorphous silica having a volume median particle size of about 2–3 micrometers or poly(methyl methacrylate-co-divinylbenzene) having a volume median particle size of about 4–5 micrometers and B. second particles comprising poly(methyl methacrylate-co-divinylbenzene) having a volume median particle size in a range of from greater than the volume median particle size of the first particles to about 12 micrometers.

Image-receiving elements provided by the invention have been unexpectedly found to exhibit higher levels of feeding reliability in an electrostatographic imaging apparatus than many receiving elements suggested in the prior art. Elements of the invention have also been unexpectedly found to exhibit high levels of feeding reliability in various different particular types of imaging apparatus.

Furthermore, receiving elements of the invention yield high quality toner images when subjected to typical processes of transferring a high quality toner image from an electrostatographic element to a surface of the receiving element and fixing the toner image on that surface.

Also, the particle-containing polymeric binder layers in elements of the invention can be uniformly coated on substrate sheets without difficulty, and the resultant elements do not exhibit undesirably high levels of dusting (i.e., dislodging of particles from the polymeric binder layers) during normal use in electrostatographic imaging machines.

DESCRIPTION OF PREFERRED EMBODIMENTS

The present invention is beneficially applicable to transparent electrostatographic-toner-image-receiving elements comprising any of the substrate sheet and image-receiving polymeric binder layer materials well known to be useful for such purposes in the prior art. By the term, "transparent", we mean that more than about 90 percent of any visible light incident on a major surface of the complete element will pass completely through the element, i.e., a level of transparency suitable for normal projection viewing purposes.

The only essential differences of elements of this invention from known transparent electrostatographic-toner-image-receiving elements lie in the present inclusion of appropriate amounts of particular mixtures of particular types and sizes of particles in image-receiving polymeric binder layers of the elements. In virtually all other respects in regard to composition, proportions, preparation, and use, the inventive elements can be the same as other transparent electrostatographic-toner-image-receiving elements described in the prior art. For detailed description of those aspects that elements of the invention can have in common with other known image-receiving elements, see, for example, all of the U.S. Patents previously identified above. A partial listing of aspects and components that the elements of this invention can have in common with known transparent electrostatographic-toner-image-receiving elements includes, for example: substrate sheet materials and thicknesses; subbing layers, materials, and thicknesses; image-receiving polymeric binder layers and binder materials; lubricants; antistatic agents; coalescing agents; coating solvents; surfactants; plasticizers; colorants; hardeners; charge control agents; biocides; methods of element manufacture; utility in typical processes of receiving transferred toner images; and utility in typical processes of fixing toner images to surfaces of the elements.

As noted above, the substrate sheet in elements of the invention can comprise any material known to be useful in the art for such purpose. In a preferred embodiment of the invention the substrate sheet comprises a self-supporting film of poly(ethylene terephthalate). Thickness of the substrate sheet is also not critical, but in a preferred embodiment of the invention the substrate sheet has a relatively uniform thickness of about 0.10 mm.

Also, as noted above, the polymeric binder in the layer on each side of the substrate sheet in the inventive element can comprise any polymeric film-forming material known to be useful in toner-image-receiving layers of transparent image-receiving elements in general. In a preferred embodiment of the invention the polymeric binder comprises poly[acrylonitrile-co-vinylidene chloride-co-2-(methacryloyloxy)ethyltrimethylammonium methylsulfate] (25/73/2, weight ratio of the monomers from which the polymer was prepared) coated onto the substrate sheet in the form of an aqueous latex containing a mixture of particles to be included in the layer in accordance with the invention and also containing an antistatic agent, a coalescing aid, and a surfactant.

The thickness of the polymeric binder portion of the layer after coating and drying is not critical, except that it should be thinner than the particle size of the particles referred to as "first particles" in the Summary of the Invention above, to assure that those particles protrude from the outer surface of the binder layer. If the layer were extremely thin, however, the particles might not be adequately held therein (depending on their size), and might dislodge from the layer during normal use in imaging machines and cause unacceptable levels of dusting. In preferred embodiments of the invention the polymeric binder portion of the dried layer has an average thickness of about 0.5 to about 1.0 micrometer. In a particularly preferred embodiment of the invention, the binder thickness is about 0.5 micrometer.

The mixture of particles dispersed in the polymeric binder layer and protruding therefrom is included at a concentration of at least about 2 percent by weight. Significantly lower concentrations of particles will not yield the degree of improvement in sheet-feeding reliability desired. For the purposes of the present invention the acceptable level of sheet-feeding reliability is defined as 2% or less misfeeds; i.e., no more than 2% of the receiving elements fed through an imaging apparatus fail to be successfully individually removed from a supply stack of such elements and/or be properly directed through the sheet-transport path of the apparatus during normal operation.

Practical upper limits of particle mixture concentration are somewhat a matter of choice, based on subjective considerations of roughness of feel and gloss level of the surface of the element desired by the user. The present inventors have determined that, based on the current subjective standards of the trade, acceptable levels of roughness of feel and gloss are generally achieved if the concentration of the mixture of particles does not exceed about 7 percent by weight. Usually, roughness of feel will increase, and level of gloss will decrease, with increasing concentration of particles.

As defined above, the mixture of particles in elements of the invention comprises "first" and "second" particles.

The "first" particles comprise either amorphous silica particles having a volume median particle size of about 2–3 micrometers or poly(methyl methacrylate-co-divinylbenzene) particles having a volume median particle size of about 4–5 micrometers.

"Volume median particle size" is a well known measure of average particle size. It is the particle size greater than the individual particle sizes of particles that together constitute 50 percent of the total volume of all the particles in the population being considered, and less than the individual particle sizes of the particles that together constitute the other 50 percent of the total volume of the particle population. In this context, "size" of any given particle means the diameter of a sphere having a volume equal to that of the given particle. Determinations of individual particle sizes and of volume median particle size are easily made using well known techniques and equipment that is widely commercially available, such as a Coulter TM Multisizer.

Amorphous silica is a well known material and is readily commercially available in the form of particles of various sizes. Amorphous silica particles having a volume median particle size of about 2–3 micrometers (useful in accordance with the invention) are commercially available, e.g., from the Davison Chemical Division of W. R. Grace and Company, USA, as Syloid TM 244.

Poly(methyl methacrylate-co-divinylbenzene) (hereinafter, sometimes also referred to as "PMMDVB") is a known crosslinked vinyl/acrylic addition copolymer that can be directly prepared in the form of spherical beads having the desired particle sizes by well known suspension polymerization techniques that use colloidal stabilizer particles (e.g., silica) to stabilize suspended droplets of polymerizing material and determine their size (by using appropriate amounts of the stabilizer) to thereby create polymeric beads of desired particle size with a relatively narrow particle size distribution. Each of the so-prepared beads comprises a single crosslinked polymeric network molecule. Divinylbenzene is the monomer that forms the crosslinks in the polymer. In preferred embodiments of the invention, the PMMDVB beads that are utilized were produced by polymerizing methyl methacrylate and divinylbenzene together in a weight ratio of 97/1.65, but other weight ratios can be used if desired to form PMMDVB particles that are also useful in accordance with the invention. PMMDVB particles useful as "first" particles in accordance with the invention have a volume median particle size of about 4–5 micrometers.

The "second" particles included in elements of the invention comprise PMMDVB particles having a volume median particles size in a range of from greater than the volume median particle size of the "first" particles to about 12 micrometers. The actual lower limit of this range depends upon whether 2–3 micrometer silica or 4–5 micrometer PMMDVB particles are used as the "first" particles. If only 2–3 micrometer silica particles are utilized as the "first" particles, 4–5 micrometer or 8–9 micrometer PMMDVB particles, for example, can serve as the "second" particles. If only 4–5 micrometer PMMDVB particles are utilized as the "first" particles, 8–9 micrometer PMMDVB particles, for example, can serve as the "second" particles.

Furthermore, the invention includes situations wherein, for example, 2–3 micrometer silica particles, 4–5 micrometer PMMDVB particles, and 8–9 micrometer PMMDVB particles are all present together in the mixture of particles. In such a situation the silica particles are "first" particles, the 8–9 micrometer PMMDVB particles are "second" particles, and the 4–5 micrometer PMMDVB particles can be viewed as "first" or "second" particles in accordance with the definition of the invention. For purposes of convenience and clarity in such situations, we arbitrarily refer to the 4–5 micrometer PMMDVB particles as "first" particles. Thus, the invention also includes cases wherein the "first" particles comprise a mixture of amorphous silica particles having a volume median particle size of about 2–3 micrometers and PMMDVB particles having a volume median particle size of about 4–5 micrometers.

The about 12 micrometer upper limit for the volume median particle size of the "second" particles is set in consideration of avoiding high levels of dusting in imaging machines. At volume median particle sizes significantly above about 12 micrometers, a relatively large number of such particles become dislodged from the polymeric binder layer during normal element use and cause undesirably high levels of dusting in the imaging apparatus. For example, we have attempted to use PMMDVB particles having a volume median particle size of about 15–16 micrometers as the "second" particles in elements otherwise in accordance with the invention and have found that such elements quickly cause unacceptably high levels of dusting during normal use in an electrophotographic copier.

As described above, the invention also encompasses including more than two different sizes of particles in the mixture of particles, but it should be noted that we have found that certain types and sizes of particles will prevent elements otherwise in accordance with the invention from achieving their goal of high feeding reliability. For example, we have fashioned elements containing "first" and "second" particles in accordance with the invention in the mixture of particles but have additionally included 6.5 micrometer or 7 micrometer amorphous silica particles in the mixture. In such cases the elements experienced a feeding failure rate much higher than 2%, while the same elements without the larger silica particles performed well within the goals of the invention. The reason for this is not known, but it is therefore preferred that the mixture of particles not contain amorphous silica particles having a volume median particle size greater than about 6 micrometers.

We have not found any criticality in the ratio of amounts of "first" to "second" particles in elements of the invention. However, in preferred embodiments of the invention the weight ratio of "first" particles: "second" particles has been in a range of from about 1:8 to about 8:1. In a particularly preferred embodiment the weight ratio is about 1:2.

As previously described, elements in accordance with the invention can be prepared by any method known to be suitable for preparation of transparent receiving elements, comprising substrate sheets having image-receiving polymeric binder layers thereon, in the prior art. The presently required mixture of particles is simply dispersed in the polymeric binder layer coating solution or dispersion along with any other desired addenda, and the desired normal coating method is then followed.

Also, as previously described, elements in accordance with the invention can be used in the same manner as prior art transparent electrostatographic-toner-image-receiving elements are used in any of the well known methods of transferring toner images to receiving elements and fixing the images thereon.

The following Examples are presented to further illustrate some preferred transparent electrostatographic-toner-image-receiving elements of the invention and their performance in various electrostatographic imaging machines and to compare their performance with that of control elements outside the scope of the invention.

In describing particle sizes in the examples, where a volume median particle size is recited, a "width index" is also recited. The width index is an indicator of the breadth of the distribution of particle sizes within a given particle population. The width index is calculated from the following values, determined in a Coulter TM Multisizer: "size at 16%", i.e., the particle size just less than the individual particle sizes of the largest particles that together comprise 16% of the total volume of all the particles in the population; "size at 50%", i.e., the volume median particle size; and "size at 84%", i.e., the particle size just less than the individual particle sizes of the largest particles that together comprise 84% of the total volume of all the particles in the population. The width index value is calculated according to the following equation.

$$\text{width index} = \frac{\frac{\text{size at 16\%}}{\text{size at 50\%}} + \frac{\text{size at 50\%}}{\text{size at 84\%}}}{2}$$

The closer the width index is to the value 1.00, the narrower is the distribution of particle sizes in the population.

EXAMPLES 1-10

Transparent electrostatographic-toner-image-receiving elements in accordance with the invention and control elements outside the scope of the invention were all prepared as follows.

Substrate sheets comprising poly(ethylene terephthalate) films having a thickness of about 0.10 mm were employed.

Image-receiving polymeric binder layers containing various types, sizes, and concentrations of particles and other addenda were coated at a coverage of 538 mg/m$^2$ on both sides of the substrate sheets in the form of about 1.8% (by weight) concentration of solids in water and dried at 93° C. for 3 minutes to form layers of about 0.5 micrometer thickness (excluding the dimensions of the particles protruding from the layers). The solids comprised: poly[acrylonitrile-co-vinylidene chloride-co-2-(methacryloyloxy)ethyltrimethylammonium methylsulfate] (25/73/2 weight ratio) to serve as the polymeric binder; ethylene carbonate to serve as a coalescing aid; poly(vinylbenzyltrimethylammonium chloride-co-ethylene dimethacrylate) (93/7 weight ratio) to serve as an antistatic conductivity agent; diethyl-p-laurylaniline surfactant; and the mixture of particles of choice. The weight ratio of polymeric binder/coalescing aid/conductivity agent/surfactant was 51.8/22.2/10.1/1.0, respectively.

Particles for the various mixtures of particles included in the various inventive and control elements were chosen from the following particles: poly(methyl methacrylate-co-divinylbenzene) (97/1.65 weight ratio) (PMMDVB) particles of two different sizes, namely: volume median particle size=4.9 micrometers (μm), and width index=1.19, and volume median particle size=8.6 micrometers (μm), and width index=1.12; Syloid TM 244 particles obtained commercially from the Davison Chemical Division of W. R. Grace and Co., USA, which are amorphous silica particles having a volume median particle size of 2.5 micrometers (μm) and a width index of 1.54; Syloid TM 221 particles obtained commercially from the Davison Chemical Division of W. R. Grace and Co., USA, which are amorphous silica particles, and are stated by the manufacturer to have an average particle size of 6.5 micrometers (μm); and Syloid TM 162 particles obtained commercially from the Davison Chemical Division of W. R. Grace and Co., USA, which are amorphous silica particles, and are stated by the manufacturer to have an average particle size of 7.0 micrometers (μm).

Identification of the particle types, sizes, and concentrations included in the image-receiving polymeric binder layers of each element is provided in Table I below.

Each type of prepared element was then tested by loading a stack of that type of element in the receiving element supply bin of a Kodak TM 1500 Series Copier-Duplicator and then operating the machine for 50 full cycles of normal operation. Each cycle included the normal steps of creating an electrostatographic toner image on a photoconductive element in the machine, feeding a receiving element from the stack of such elements to the transfer station in the machine, transferring the toner image from the photoconductive element to one surface of the receiving element, feeding the toner-image-bearing receiver element to a fixing station, fixing the toner image on the receiver element, and then feeding the element out of the machine. Any failure of a receiving element to be properly fed from the stack of elements or to be properly fed through the machine as intended was noted. The 50-full-cycle test of each type of element was repeated on two other Kodak TM 1500 Series Copier-Duplicators. All three machines were previously tested and chosen for their capability of feeding plain paper receiving elements through the machine at a 0% failure rate. The combined failure rate over the three 50-full-cycle tests for each type of element was then calculated to yield a value in terms of percent of receiving elements that experienced a feeding failure during normal machine operation. Results are reported in Table I.

TABLE I

| Example | Particles in binder layer | Particle size* (μm) | Particle concentration in binder layer (weight %) | Failure rate of element (%) |
|---|---|---|---|---|
| 1 | Syloid 244 | 2.5 | 1.0 | 1.2 |
| | PMMDVB | 8.6 | 2.0 | |
| 2 | Syloid 244 | 2.5 | 1.7 | 0 |
| | PMMDVB | 8.6 | 1.7 | |
| 3 | PMMDVB | 4.9 | 1.7 | 0.7 |
| | PMMDVB | 8.6 | 1.7 | |
| 4 | Syloid 244 | 2.5 | 1.0 | 0 |
| | PMMDVB | 4.9 | 1.0 | |
| | PMMDVB | 8.6 | 2.0 | |
| 5 | Syloid 244 | 2.5 | 1.7 | 0 |
| | PMMDVB | 4.9 | 1.7 | |
| | PMMDVB | 8.6 | 3.7 | |
| 6 | Syloid 244 | 2.5 | 2.7 | 0 |
| | PMMDVB | 4.9 | 2.7 | |
| | PMMDVB | 8.6 | 2.7 | |
| 7 | Syloid 244 | 2.5 | 3.7 | 0 |
| | PMMDVB | 4.9 | 1.7 | |
| | PMMDVB | 8.6 | 1.7 | |
| 8 | Syloid 244 | 2.5 | 1.7 | 0 |
| | PMMDVB | 4.9 | 1.7 | |
| | PMMDVB | 8.6 | 1.7 | |
| 9 | Syloid 244 | 2.5 | 1.7 | 0 |
| | PMMDVB | 4.9 | 3.7 | |
| | PMMDVB | 8.6 | 1.7 | |
| 10 | Syloid 244 | 2.5 | 0.7 | 2.0 |
| | PMMDVB | 4.9 | 0.7 | |
| | PMMDVB | 8.6 | 2.7 | |
| Control A | Syloid 244 | 2.5 | 1.0 | 2.2 |
| Control B | PMMDVB | 8.6 | 2.0 | 2.2 |
| Control C | PMMDVB | 4.9 | 1.0 | 3.0 |
| Control D | Syloid 221 | 6.5 | 2.0 | 3.7 |
| | Syloid 244 | 2.5 | 1.0 | |
| | PMMDVB | 8.6 | 2.0 | |
| Control E | Syloid 221 | 6.5 | 2.0 | 13.0 |
| Control F | Syloid 162 | 7.0 | 3.0 | 13.0 |
| | Syloid 244 | 2.5 | 1.0 | |
| Control G | Syloid 221 | 6.5 | 2.0 | 15.0 |
| | PMMDVB | 4.9 | 1.0 | |
| | PMMDVB | 8.6 | 2.0 | |
| Control H | Syloid 221 | 6.5 | 2.0 | 17.0 |
| | Syloid 244 | 2.5 | 1.0 | |
| | PMMDVB | 4.9 | 1.0 | |

*Stated as volume median particle size, except for Syloid 162 and Syloid 221 for which the values stated are "average particle size" reported by the manufacturer without defining "average".

The results in Table I illustrate that elements in accordance with the invention exhibited high feeding reliability (failure rate of 2% or less), while the control elements outside the scope of the invention exhibited much lower feeding reliability (failure rate greater than 2%).

Also, in the tests all of the elements of examples 1–10 received transferred toner images very well that were then fixed very well to their surfaces to yield high quality toner images on the elements.

Furthermore, none of the elements of Examples 1–10 created undesirably high levels of dusting in the imaging machines during the tests.

EXAMPLE 11

Elements prepared in accordance with Example 1 were also tested in six Kodak TM ColorEdge TM Copier-Duplicators. More than 1000 Example 1 elements (total) were subjected to full cycles of operation in the six machines. High quality toner images resulted; there were no undesirably high dusting levels; and the feeding failure rate was only 0.4%.

EXAMPLES 12–19

Elements prepared in accordance with each of Examples 2, 3, and 5–10 were also subjected to 50-full-cycle tests in a Kodak TM ColorEdge TM Copier-Duplicator. They all yielded high quality images, low dusting levels, and a 0% feeding failure rate.

EXAMPLE 20

Elements prepared in accordance with Example 1 were subjected to a 550-full-cycle test in one Kodak TM 2100 Series Duplicator and to a 200-full-cycle test in another Kodak TM 2100 Series Duplicator. The elements in both tests yielded high quality images, low dusting levels, and a 0% feeding failure rate.

The invention has been described in detail with particular reference to certain preferred embodiments thereof, but it should be appreciated that variations and modifications can be effected within the spirit and scope of the invention.

What is claimed is:

1. A transparent electrostatographic-toner-image-receiving element that will exhibit improved feeding reliability in electrostatographic imaging apparatus, said element comprising a substrate sheet having on each side thereof a layer comprising a polymeric binder having dispersed therein, at a concentration of at least 2 percent by weight, a mixture of particles protruding from the layer, said mixture comprising:

A. first particles comprising either amorphous silica having a volume median particle size of 2–3 micrometers or poly(methyl methacrylate-co-divinylbenzene) having a volume median particle size of 4–5 micrometers and B. second particles comprising poly(methyl methacrylate-co-divinylbenzene) having a volume median particle size in a range of from greater than the volume median particle size of the first particles to 12 micrometers, wherein said mixture does not contain amorphous silica particles having a volume median particle size greater than 6 micrometers.

2. The element of claim 1, wherein the polymeric binder in the layer on each side of the substrate sheet has an average thickness from 0.5 to 1.0 micrometer.

3. The element of claim 2, wherein the polymeric binder has an average thickness of 0.5 micrometer.

4. The element of claim 1, having a weight ratio of first particles:second particles in a range of from 1:8 to 8:1.

5. The element of claim 4, wherein the weight ratio is 1:2.

6. The element of claim 1, wherein the first particles comprise a mixture of amorphous silica particles having a volume median particle size of 2–3 micrometers and poly(methyl methacrylate-co-divinylbenzene) particles having a volume median particle size of 4–5 micrometers.

7. The element of claim 1, wherein the first particles comprise amorphous silica and the second particles comprise poly(methyl methacrylate-co-divinylbenzene).

8. The element of claim 1, wherein the concentration of the mixture of particles in the layer on each side of the substrate sheet is in a range of from 2 to 7 percent by weight.

9. The element of claim 1, wherein the polymeric binder in the layer on each side of the substrate sheet has an average thickness of 0.5 micrometers, the first particles comprise 1 percent by weight of the layer and comprise amorphous silica particles having a volume median particle size of 2–3 micrometers, and the second particles comprise 2 percent by weight of the layer and comprise poly(methyl methacrylate-co-divinylbenzene) particles having a volume median particle size of 8–9 micrometers.

* * * * *